US006582872B2

(12) United States Patent
Willnow et al.

(10) Patent No.: US 6,582,872 B2
(45) Date of Patent: Jun. 24, 2003

(54) PROCESS FOR FABRICATING ELECTROPHOTOGRAPHIC IMAGING MEMBER

(75) Inventors: Alfred H. Willnow, Ontario, NY (US); Kent J. Evans, Lima, NY (US); Edward F. Grabowski, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/682,380

(22) Filed: Aug. 27, 2001

(65) Prior Publication Data

US 2003/0039914 A1 Feb. 27, 2003

(51) Int. Cl.[7] ..... G03G 5/047
(52) U.S. Cl. ..... 430/133; 430/58.05; 430/132
(58) Field of Search ..... 430/58.05, 129, 430/132, 133

(56) References Cited

U.S. PATENT DOCUMENTS 5,830,613 A 11/1998 Carmichael et al. ..... 430/64
5,906,904 A * 5/1999 Parikh et al. ..... 430/58.05
6,048,658 A 4/2000 Evans et al. ..... 430/132
6,214,514 B1 4/2001 Evans et al. ..... 430/133

FOREIGN PATENT DOCUMENTS

JP 2-124576 * 5/1990

OTHER PUBLICATIONS

Derwent Abstract Acc. No. 1990–189508 discribing JP 2–124576, 1990.*

US Patent & Trademark Office (USPTO) English–Language Translation of JP 2–124576 (pub 5/90).*

Diamond, A. S. ed. *Handbook of Imaging Materials*, Marcel Dekker, Inc, NY (1991), pp. 395–396, 1991.*

* cited by examiner

*Primary Examiner*—Janis L. Dote
(74) *Attorney, Agent, or Firm*—Oliff & Berridge, PLC

(57) ABSTRACT

An electrophotographic imaging member is produced using a substrate coated with a charge transport layer, the material used to coat the charge transport layer has a viscosity of about 1500–2100 cps. This results in decreased variation in charge transport layer thickness.

4 Claims, 5 Drawing Sheets

PROCESS FOR FABRICATING ELECTROPHOTOGRAPHIC IMAGING MEMBER

BACKGROUND OF THE INVENTION

1. Field of Invention

This invention relates in general to a process for fabricating electrophotographic imaging members.

2. Description of Related Art

Typical electrophotographic imaging members comprise a photoconductive layer comprising a single layer or composite layers. One type of composite photoconductive layer used in xerography is illustrated, for example, in U.S. Pat. No. 4,265,990, incorporated herein by reference in its entirety. The 990 patent describes a photosensitive member having at least two electrically operative layers. One layer comprises a photoconductive layer which is capable of photogenerating holes and injecting the photogenerated holes into a contiguous charge transport layer.

Generally, where the two electrically operative layers are supported on a conductive layer, the photogenerating layer is sandwiched between the contiguous charge transport layer and the supporting conductive layer. The outer surface of the charge transport layer is normally charged with a uniform electrostatic charge. The photosensitive member is then exposed to a pattern of activating electromagnetic radiation, such as light. The activating electromagnetic radiation selectively dissipates the charge in illuminated areas of the photosensitive member, while leaving behind an electrostatic latent image in the non-illuminated areas. This electrostatic latent image may then be developed to form a visible image, by depositing finely divided electrostatic toner particles on the surface of the photosensitive member. The resulting visible toner image can be transferred to a suitable receiving material, such as paper. This imaging process may be repeated many times with reusable photosensitive members.

As more advanced, complex, and highly sophisticated, electrophotographic copiers, duplicators and printers have been developed, greater demands have been placed on the photoreceptor to meet stringent requirements for the production of high quality images. For example, to provide excellent toner images over many thousands of cycles, the numerous layers found in many modern photoconductive imaging members must be uniform, free of defects, adhere well to adjacent layers, and exhibit predictable electrical characteristics within narrow operating limits. One type of multilayered photoreceptor that has been employed, in drum or belt form, in electrophotographic imaging systems comprises a substrate, a conductive layer, a charge blocking layer, an adhesive layer, a charge generating layer, and a charge transport layer. This photoreceptor may also comprise additional layers, such as an overcoating layer.

Excellent toner images may be obtained with this and other multilayered photoreceptors. However, it has been found that the numerous layers limit the versatility of the multilayered photoreceptor. For example, when a thick, e.g., 29 micrometer, charge transport layer is formed in a single pass, a "raindrop" pattern forms on the exposed imaging surface of the final dried photoreceptor. This is discussed in detail in U.S. Pat. No. 6,214,514 to Evans et al., which is incorporated herein by reference in its entirety. This "raindrop" phenomenon is a print defect caused by high frequency coating thickness variations in the relatively thick (e.g., 29 micrometer) charge transport layer. More specifically, the expression raindrop, as employed herein, is defined as a high frequency variation in the layer thickness. The spatial period of this variation is in the 0.1 cm to 2.5 cm range. The amplitude of this variation is between 0.5 micrometer and 1.5 micrometer. The "raindrop" variation can also be defined on a per unit area basis. The raindrop defect can occur when the transport layer thickness variation is in the range of 0.5 to 1.5 microns per sq. cm. The morphological structure of raindrop defect is variable and depends on where and how the device is coated. The structure can be periodic or random, symmetrical or oriented.

U.S. Pat. No. 6,214,541 discloses a process for fabricating electrophotographic imaging members including providing an imaging member including a substrate coated with a charge generating layer having an exposed surface, applying a first solution including a charge transporting small molecule and film-forming binder to the exposed surface to form a first charge transporting layer having a thickness of greater than about 13 micrometers and less than about 20 micrometers in the dried state and an exposed surface, and applying at least a second solution having a composition substantially identical to the first solution to the exposed surface of the first charge transportation layer to form at least a second continuous charge transporting layer, the at least second charge transporting layer having a thickness in the dried state of less than about 20 micrometers, the at least second charge transporting layer, and any subsequent applied solution having a composition substantially identical to the first solution.

Although this is considered an acceptable solution, it results in an extra coating pass leading to higher manufacturing costs.

SUMMARY OF THE INVENTION

This invention provides systems and methods for fabricating an electrophotographic imaging member having reduced raindrop variation.

This invention separately provides systems and methods for achieving coating uniformity in a single charge transport layer formed in a single pass.

This invention separately provides systems and methods for reducing raindrop defects in single charge transport layers formed in a single pass.

The systems and methods for fabricating electrophotographic imaging members according to this invention comprise forming an imaging member having a substrate coated with a charge transport layer, where the material used to form the charge transport layer has a viscosity of about 1500–2100 cps.

If desired, after forming the charge transport layer, the resulting electrophotographic imaging member may optionally be coated with any suitable known or later-developed overcoating layer.

Other layers, such as conventional ground strips comprising, for example, conductive particles dispersed in a film-forming binder, may be applied to one edge of the multilayer photoreceptor and in contact with the conductive surface, blocking layer, adhesive layer or charge generating layer.

In various exemplary embodiments, a back coating layer may be applied to the side of the substrate opposite the multilayer photoreceptor to provide flatness and/or abrasion resistance. This back coating layer may comprise an organic polymer or inorganic polymer that is electrically insulating or slightly semi-conductive.

The multilayer photoreceptor manufactured according to this invention may be employed in any suitable conventional or later-developed electrophotographic imaging process which utilizes charging prior to imagewise exposure to activating electromagnetic radiation. Conventional positive or reversal development techniques may be employed to form a marking material image on the imaging surface of the electrophotographic imaging member of this invention.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein.

DETAILED DESCRIPTION OF PREFERRED EMBODIMENTS

Figure 1:
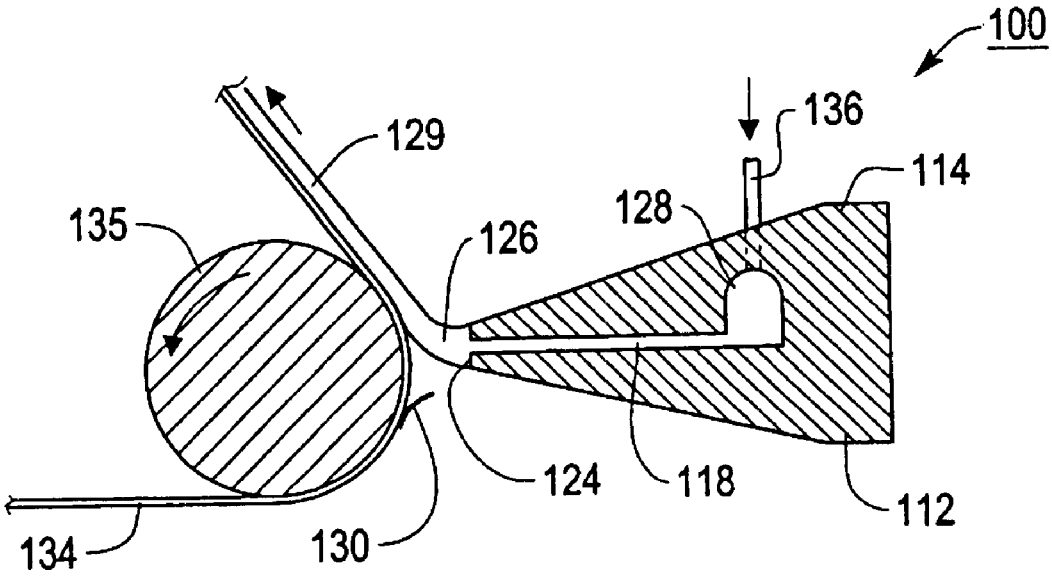
FIG. 1 illustrates a schematic cross-sectional view of a single slot coating system according to this invention.

Generally, most types of photoreceptors comprise a supporting substrate having an electrically conductive surface layer, an optional charge blocking layer on the electrically conductive surface, an optional adhesive layer, a charge generating layer on the blocking layer and a transport layer on the charge generating layer.

The supporting substrate may be opaque or substantially transparent and may be fabricated from various materials having the requisite mechanical properties. The supporting substrate may comprise electrically non-conductive or conductive, inorganic or organic composition materials. The supporting substrate may be rigid or flexible and may have a number of different configurations such as, for example, a cylinder, sheet, a scroll, an endless flexible belt, or the like. In various exemplary embodiments, the supporting substrate is in the form of an endless flexible belt, and comprises a commercially available biaxially-oriented polyester, such as MYLAR® and available from E.I. du Pont de Nemours & Co., or MELINEX® available from ICI. Other exemplary electrically non-conducing materials known for this purpose include polyesters, polycarbonates, polyamides, polyurethanes, and the like.

The average thickness of the supporting substrate depends on numerous factors, including economic considerations. A flexible belt may be of substantial thickness, for example, over 200 micrometers, or have a minimum thickness less than 50 micrometers, provided there are no adverse affects on the final multilayer photoreceptor device. In various embodiments of a flexible belt supporting substrate, the average thickness of the support layer ranges from about 65 micrometers to about 150 micrometers. The average thickness of the support layer ranges from about 75 micrometers to about 125 micrometers for improved flexibility and reduced stretch when cycled around small diameter rollers, such as, for example, 12 millimeter diameter rollers.

The electrically conductive surface layer may vary in average thickness over substantially wide ranges depending on the optical transparency and flexibility desired for the multilayer photoreceptor. Accordingly, when a flexible multilayer photoreceptor is desired, the thickness of the electrically conductive surface layer may be between about 20 Angstroms to about 750 Angstroms. The thickness of the electrically conductive surface layer may range from about 50 Angstroms to about 200 Angstroms for a particularly useful combination of electrical conductivity, flexibility and light transmission.

The electrically conductive surface layer may be a metal layer formed, for example, on the support layer by a coating technique, such as a vacuum deposition. Typical metals employed for this purpose include aluminum, zirconium, niobium, tantalum, vanadium and hafnium, titanium, nickel, stainless steel, chromium, tungsten, molybdenum, and the like. Useful metal alloys may contain two or more metals, such as zirconium, niobium, tantalum, vanadium and hafnium, titanium, nickel, stainless steel, chromium, tungsten, molybdenum, and the like.

Regardless of the technique employed to form the metal layer, a thin layer of metal oxide may form on the outer surface of most metals upon exposure to air. Thus, when other layers overlying a (metal) electrically conductive surface layer are described as "contiguous" layers, it is intended that these overlying contiguous layers may, in fact, contact a thin metal oxide layer that has formed on the outer surface of the oxidizable metal layer. For improved electrical behavior, the average thickness for the thin metal oxide layers should be between about 30 Angstroms and about 60 Angstroms.

Generally, for rear erase exposure, a conductive layer light transparency of at least about 15 percent is desirable. The light transparency allows the design of machines employing erase from the rear. The electrically conductive surface layer need not be limited to metals. Other examples of conductive layers may be combinations of materials such as conductive indium-tin oxide as a transparent layer for light having a wavelength between about 4000 Angstroms and about 7000 Angstroms or a conductive carbon black dispersed in a plastic binder as an opaque conductive layer.

After depositing the electrically conductive surface layer, an optional blocking layer may be applied to the electrically conductive surface layer. Generally, electron blocking layers for positively charged photoreceptors allow holes from the imaging surface of the photoreceptor to migrate toward the conductive layer. For use in negatively charged systems, any suitable blocking layer capable of forming an electronic barrier to holes between the adjacent multilayer photoreceptor layers and the underlying conductive layer may be used. The blocking layer may be organic or inorganic and may be deposited by any suitable technique. For example, if the blocking layer is soluble in a solvent, it may be applied as a solution. The solvent can subsequently be removed from the solution by any conventional method, such as by drying.

Typical blocking layers include polyvinylbutyral, organosilanes, epoxy resins, polyesters, polyamides, polyurethanes, pyroxyline vinylidene chloride resin, silicone resins, fluorocarbon resins and the like containing an organo-metallic salt. The blocking layer may comprise a reaction product between a hydrolyzed silane and a thin metal oxide layer formed on the outer surface of an oxidizable metal electrically conductive surface. Other blocking layer materials include nitrogen-containing siloxanes or nitrogen-containing titanium compounds such as trimethoxysilyl propylene diamine, hydrolyzed trimethoxysilylpropylethylene diamine, N-beta-(aminoethyl)-gamma-aminopropyltrimethoxy silane, isopropyl-4-aminobenzene sulfonyl, di(dodecylbenzene sulfonyl)titanate, isopropyl-di(4-aminobenzoyl)isostearoyl titanate, isopropyl-tri(N-ethylamino-ethylamino)titanate, isopropyl trianthranil titanate, isopropyl-tri-(N,N-dimethylethylamino)titanate, titanium-4-amino benzene sulfonatoxyacetate, titanium 4-aminobenzoate-isostearateoxyacetate, [H2N(CH2)4]CH3Si(OCH3)2, (gamma-aminobutyl)methyl diethoxysilane, and [H2N(CH2)3]CH3Si(OCH3)2 (gamma-aminopropyl)methyldiethoxy silane, as disclosed in U.S. Pat. Nos. 4,291,110, 4,338,387, 4,286,033 and 4,291,110, each of which is incorporated herein by reference in its entirety.

In various exemplary embodiments, the blocking layer is continuous and usually has an average thickness of less than about 5000 Angstroms. In various exemplary embodiments, the blocking layer has a thickness between about 50 Angstroms and about 3000 Angstroms. This thickness range tends to facilitate charge neutralization after light exposure of the multilayer photoreceptor and improve electrical performance. The blocking layer may be applied by any suitable known or later-developed technique, such as spraying, dip coating, draw bar coating, gravure coating, silk screening, air knife coating, reverse roll coating, vacuum deposition, extrusion coating, slot coating, chemical treatment and the like. In various exemplary embodiments, for convenience in obtaining thin layers, the blocking layers are applied in the form of a dilute solution. In this case, the solvent is removed after depositing of the coating by any suitable known or later-developed technique, such as vacuum, heating and the like. Generally, a weight ratio of blocking layer material and solvent of between about 0.05:100 and about 0.5:100 is satisfactory for spray coating. A typical siloxane coating is described in U.S. Pat. No. 4,464,450, incorporated herein by reference in its entirety.

If desired, an optional adhesive layer may be applied over the hole blocking layer or over the conductive surface. Typical adhesive layers include a polyester resin, such as VITEL PE-100®, VITEL PE-200®, VITEL PE-200D®, and VITEL PE-222®, all available from Goodyear Tire and Rubber Co., DuPont 49,000 polyester, polyvinyl butyral, and the like. When an adhesive layer is employed, the adhesive layer is, in various exemplary embodiments, continuous. In various exemplary embodiments, the adhesive layer has an average dry thickness between about 200 Angstroms to about 900 Angstroms. The adhesive dry layer may have an average dry thickness between about 400 Angstroms to about 700 Angstroms.

Any suitable known or later-developed solvent or solvent mixtures may be employed to form a coating solution for the adhesive layer material. Typical solvents include tetrahydrofuran, toluene, methylene chloride, cyclohexanone, and mixtures of these materials. In various exemplary embodiments to achieve a continuous adhesive layer dry thickness of about 900 Angstroms or less using gravure coating, the solids concentration of the solution is about 2 percent to about 5 percent by weight based on the total weight of the coating mixture of resin and solvent. However, any suitable known or later-developed technique may be utilized to mix and apply the adhesive layer coating mixture to the charge blocking layer. Typical application techniques include spraying, dip coating, roll coating, wire wound rod coating, extrusion or slot coating, and the like. Drying the deposited coating may be effected by any suitable known or later-developed technique, such as oven drying, infra red radiation drying, air drying and the like.

A charge generating layer is applied over the blocking layer, or over the adhesive layer, if either is employed. The charge generating layer can then be overcoated with a charge transport layer, as described herein. Examples of a charge generating layer include inorganic photoconductive particles, such as amorphous selenium, trigonal selenium, and selenium alloys, such as selenium-tellurium, selenium-tellurium-arsenic, selenium arsenide and mixtures of these alloys, and organic photoconductive particles, including various phthalocyanine pigments, such as the X-form of metal-free phthalocyanine, which is described in U.S. Pat. No. 3,357,989, metal phthalocyanines, such as vanadyl phthalocyanine, titanyl phthalocyanines, hydroxycalcium phthalocyanines and copper phthalocyanine. Any suitable or later developed pigment such as quinacridones (available from DuPont under the trade name MONASTRAL RED®, MONASTRAL VIOLET® and MONASTRAL RED Y®), may be used. Other pigments include VAT ORANGE 1® and VAT ORANGE 3®, trade names for dibromoanthrone pigments, benzimidazole perylene, substituted 3,4-diaminotriazines as disclosed in U.S. Pat. No. 3,442,781. Polynuclear aromatic quinones available from Allied Chemical Corporation under the tradename INDOFAST DOUBLE SCARLET®, and INDOFAST VIOLET LAKE B®. INDOFAST BRILLIANT SCARLET® and INDOFAST ORANGE®. The pigments are dispersed in a film-forming polymeric binder.

Selenium, selenium alloy, benzimidazole perylene, and the like and mixtures of these materials may be formed as a continuous, homogeneous charge generating layer. Benzimidazole perylene compositions are well known and described, for example, in U.S. Pat. No. 4,587,189. Multiphotogenerating layer compositions may be utilized, where an additional photoconductive layer may enhance or reduce the properties of the charge generating layer. Examples of this type of configuration are described in U.S. Pat. No. 4,415,639. Other suitable charge generating materials known in the art may also be utilized, if desired. Charge generating binder layers comprising particles or layers including a photoconductive material, such as vanadyl phthalocyanine, titanyl phthalocyanines, metal-free phthalocyanine, benzimidazole perylene, amorphous selenium, trigonal selenium, selenium alloys such as selenium-tellurium, selenium-tellurium-arsenic, selenium arsenide and the like, and mixtures of these selenium alloys are particularly useful because of their sensitivity to white light. Vanadyl phthalocyanine, titanyl phthalocyanines, metal-free phthalocyanine, hydroxygallium phthalocyanine and tellurium alloys are also particularly useful because these materials provide the additional benefit of being sensitive to infra-red light.

Numerous inactive resin materials may be employed in the charge generating binder layer including those described, for example, in U.S. Pat. No. 3,121,006. Typical organic resinous binders include thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly (amide-imide), styrene-butadiene copolymers, poly styrene-vinylpyridine copolymers, vinylidenechloride-vinylchloride copolymers, vinylacetate-vinylidenechloride copolymers, styrene-alkyd resins, and the like. These polymers may be block, random or alternating copolymers.

An active transporting polymer containing charge transporting segments may also be employed as the binder in the charge generating layer. These polymers are particularly useful when the concentration of carrier-generating pigment particles is low and the average thickness of the carrier-generating layer is substantially thicker than about 0.7 micrometer. One active polymer commonly used as a binder is polyvinylcarbazole, which is able to transport carriers which would otherwise be trapped in the charge transport layer.

Electrically active polymeric arylamine compounds can be employed in the charge generating layer to replace the polyvinylcarbazole binder or another active or inactive binder. Part or all of the active resin materials to be employed in the charge generating layer may be replaced by electrically active polymeric arylamine compounds.

The photogenerating composition or pigment is present in the resinous binder composition in various amounts. Generally, however, the photogenerating composition or pigment forms from about 5 percent by volume to about 90 percent by volume of the photogenerating pigment, which is dispersed in about 95 percent by volume to about 10 percent by volume of the resinous binder, respectively. In various exemplary embodiments, the photogenerating pigment forms from about 20 percent by volume to about 30 percent by volume, which is dispersed in about 80 percent by volume to about 70 percent by volume of the resinous binder composition, respectively. In various exemplary embodiments, about 8 percent by volume of the photogenerating pigment is dispersed in about 92 percent by volume of the resinous binder composition.

For those exemplary embodiments in which the charge generating layers do not contain a resinous binder, the charge generating layer may comprise any suitable, known or later-developed homogeneous photogenerating material. Typical homogenous photogenerating materials include inorganic photoconductive compounds, such as amorphous selenium, selenium alloys, such as selenium-tellurium, selenium-tellurium-arsenic, and selenium arsenide, and organic materials, such as benzamidazole perylene, vanadyl phthalocyanine, chlorindium phthalocyanine, chloraluminum phthalocyanine, and the like.

The charge generating layer, containing photoconductive compositions and/or pigments and the resinous binder material, generally ranges in average thickness from about 0.1 micrometer to about 5 micrometers. A charge generating layer having an average thickness from about 0.3 micrometer to about 3 micrometers is particularly useful. The charge generating layer thickness is related to binder content. Higher binder content compositions generally result in thicker layers for photogeneration. Thicknesses outside these ranges can be used provided the results to be obtained by this invention are achieved.

The active charge transport layer may comprise any suitable known or later-developed non-polymeric small molecule charge transport material capable of supporting the injection of photogenerated holes and electrons from the charge generating layer and allowing the transport of these holes or electrons through the charge transport layer to selectively discharge the surface charge. The active charge transport layer not only transports holes or electrons, but also protects the charge generating layer from abrasion or chemical attack. Therefore, the active charge transport layer also extends the operating life of the photoreceptor imaging member.

In various exemplary embodiments, the active charge transport layer is a substantially non-photoconductive material which supports the injection of photogenerated holes or electrons from the charge generating layer. In various exemplary embodiments, the active charge transport layer is transparent when the charge generating layer is exposed through the active charge transport layer. This ensures that most of the incident radiation is utilized by the underlying charge generating layer to efficiently photogenerate charge. The active charge transport layer, in conjunction with the charge generating layer, act as an insulator to the extent that an electrostatic charge placed on the active charge transport layer is not conducted in the absence of activating illumination. For reasons of convenience, the discussion will refer to charge carriers or hole transport. However, transporting electrons is also contemplated as within the scope of this invention.

Any suitable known or later-developed soluble non-polymeric small molecule transport material may be employed in the charge transport layer coating mixture. This small molecule transport material is dispersed in an electrically inactive polymeric film, forming materials to make these materials electrically active. These non-polymeric activating materials are added to those film-forming polymeric materials which are incapable of supporting the injection of photogenerated holes from the generation material and incapable of allowing the transport of these holes through the active change transport layer. This will convert the electrically inactive polymeric material to a material capable of supporting the injection of photogenerated holes from the charge generating material and capable of allowing the transport of these holes through the active charge transport layer to discharge the surface charge on the active layer.

Any suitable known or later-developed non-polymeric small molecule charge transport material which is soluble or dispersible on a molecular scale in a film-forming binder and able to achieve the proper viscosity may be utilized in the continuous phase of the active charge transport layer according to this invention. The charge transport molecule should be capable of transporting charge carriers injected by the charge injection enabling particles in an applied electric field. The charge transport molecules may be hole transport molecules or electron transport molecules. Typical charge transporting materials include the following:

Diamine transport molecules are described in U.S. Pat. Nos. 4,306,008, 4,304,829, 4,233,384, 4,115,116, 4,299,897, 4,265,990 and 4,081,274. Typical diamine transport molecules include N,N'-diphenyl-N,N'-bis(alkylphenyl)-[1,1'-biphenyl]-4,4'-diamine, where the alkyl is, for example, methyl, ethyl, propyl, n-butyl, etc., such as N,N'-diphenyl-N,N'-bis(3"-methylphenyl)-[1,1'-biphenyl]-4,4'-diamine, N,N'-diphenyl-N,N'-bis(2-methylphenyl)-[1,1'-biphenyl ]-4,4'diamine, N,N'-diphenyl-N,N'-bis(2-methylphenyl)-[1,1'-biphenyl]-4,4'-diamine, N,N'-diphenyl-N,N'-bis(3-ethylphenyl)-[1,1'-biphenyl]-4,4'-diamine, N,N'-diphenyl-N,N'-bis(4-ethylphenyl)-[1,1'-biphenyl]-4,4'-diamine, N,N'-diphenyl-N,N'-bis(4-n-butylphenyl)-[1,1'-biphenyl]-4,4'-diamine, N,N'-diphenyl-N,N'-bis(3-chlorophenyl)-[1,1'- biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules are disclosed in U.S. Pat. Nos. 4,315,982, 4,278,746, and 3,837,851. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl)pyrazoline, 1-phenyl-3-[p-dimethylaminostyryl]-5-(p-dimethylaminostyryl) pyrazoline, 1-phenyl-3-[p-diethylaminostyryl]-5-(p-diethylaminostyryl)pyrazoline, and the like.

Substituted fluorene charge transport molecules are described in U.S. Pat. No. 4,245,021. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene, 2-nitro-9-(4'-diethylaminobenzylidene)fluorene and the like.

Oxadiazole transport molecules such as 2,5-bis(4-diethylaminophenyl)-1,3,4-oxadiazole, pyrazoline, imidazole, triazole, and others are described in German Patents 1,058,836, 1,060,260 and 1,120,875 and U.S. Pat. No. 3,895,944.

Hydrazone including, for example, p-diethylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), p-dipropylaminobenzaldehyde-(diphenylhydrazone), p-diethylaminobenzaidehyde-(benzylphenylhydrazone), p-dibutylaminobenzaldehyde-(diphenylhydrazone), p-dimethylaminobenzaldehyde-(diphenylhydrazone) and the like described, for example in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and other hydrazone transport molecules are described, for example in U.S. Pat. Nos. 4,385,106, 4,338,388, 4,387,147, 4,399,208, and 4,399,207.

Still another charge transport molecule is carbazole phenyl hydrazone. Typical examples of carbazole phenyl hydrazone transport molecules include 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. No. 4,256,821. Similar hydrazone transport molecules are described, for example, U.S. Pat. No. 4,297,426.

Tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane are described, for example, in U.S. Pat. No. 3,820,989.

In various exemplary embodiments, the charge transport layer forming solution comprises an aromatic amine compound as the activating compound. One particularly useful charge transport layer composition that can be used in the charge transport layer coating fabrication method according to this invention comprises from about 35 percent to about 50 percent by weight of at least one charge transporting aromatic amine compound, and about 65 percent to about 55 percent by weight of a polymeric film-forming resin in which the aromatic amine is soluble. The substituents should be free from electron withdrawing groups, such as $NO_2$ groups, CN groups, and the like. Typical aromatic amine compounds include, for example, triphenylmethane, bis(4-diethylamine-2-methylphenyl)phenylmethane; 4"-4-bis(diethylamino)-2",2-dimethyltriphenylmethane, N,N"-bis(alkylphenyl)-[1,1"-biphenyl]-4,4"-diamine wherein the alkyl is, for example, methyl, ethyl, propyl, n-butyl, etc., N,N"-diphenyl-N,N"-bis(chlorophenyl)-[1,1"-biphenyl]-4,4"-diamine, 1,1"-biphenyl)-4,4"-diamine, and the like dispersed in an inactive resin binder.

Any suitable known or later-developed soluble inactive film-forming binder may be utilized in the charge transport layer coating mixture. The inactive polymeric film-forming binder may be soluble, for example, in methylene chloride, chlorobenzene or other suitable solvent. Typical inactive polymeric film-forming binders include polycarbonate resin, polyester, polyarylate, polyacrylate, polyether, polysulfone, and the like. Molecular weights can vary, for example, from about 20,000 to about 1,500,000. Polycarbonates are particularly useful as film-forming polymers for charge transport layers. Typical film-forming polymer polycarbonates include, for example, bisphenol polycarbonate, poly(4,4'-isopropylidene diphenyl carbonate), 4,4'-cyclohexylidene diphenyl polycarbonate, bisphenol A type polycarbonate of 4,4"-isopropylidene (commercially available form Bayer AG as MAKROLON®), poly(4,4"-diphenyl-1,1"-cyclohexane carbonate) and the like. The polycarbonate resins typically employed for charge transport layer applications have a weight-average molecular weight from about 70,000 to about 150,000.

FIG. 1 illustrates a single slot coating applicator assembly 100. Slot coating dies are well known and are described, for example, in U.S. Pat. Nos. 4,521,457 and 5,614,260, each one incorporated herein by reference in its entirety. The single slot coating applicator assembly 100 comprises a lower lip 112 and an upper lip 114 that combine to form passageway 118. The passageway 118 is, in various exemplary embodiments, flat and/or narrow. The passageway 118 leads from a manifold 128 to a single exit slot 124.

A small molecule transport layer coating dispersion having a viscosity of between approximately 1500–2100 cps is fed into the manifold 128 through a feed pipe 136 and is extruded as a ribbon-like stream 126 through the passageway 118 and out of the single exit slot 124 onto substrate 134 as a charge transport layer 129. The substrate 134 is supported by a rotatable roll 135. As shown in FIG. 1, the ribbon-like stream 126 of coating material forming the charge transport layer is deposited across a gap 130 on the substrate 134 in a very thin layer having a thickness of approximately 29 microns. The width, thickness, and the like of the ribbon-like stream 126 can be varied in accordance with factors such as the viscosity of the coating composition, the desired thickness for the coating layer, and the width of the substrate 134 on which the coating compositions are applied, and the like.

End dams (not shown) are secured to the ends of the lower lip 112 and the upper lip 114 of the single slot coating applicator assembly 110 to confine the coating composition within the manifold 128 and the passageway 118 as the coating composition travels from the feed pipe 136 through the manifold 128, to the exit slot 124. The length of the passageway 118 should be sufficiently long to ensure laminar flow. Controlling the distance of the exit slot 124 from the substrate 134 enables the ribbon-like stream 126 of the coating composition to bridge the gap 130 between the exit slot 124 and the substrate 134, depending upon the viscosity of the coating composition, the rate of flow of the coating composition through the passageway 118, and the relative rate movement between the single slot coating applicator assembly 100 and the substrate 134.

As conventional in the art, the coating composition is supplied from reservoirs (not shown) using a conventional pump or other suitable known or later-developed devices or apparatus, such as a gas pressure system (not shown). The surfaces of the passageway 118 are precision ground to ensure accurate control of the thickness and uniformity of the ribbon-like stream 126 on the substrate 134. The coated substrate 134 is thereafter transported to any suitable drying device to dry the charge generating layer coating and charge transport layer coating.

Figure 2:
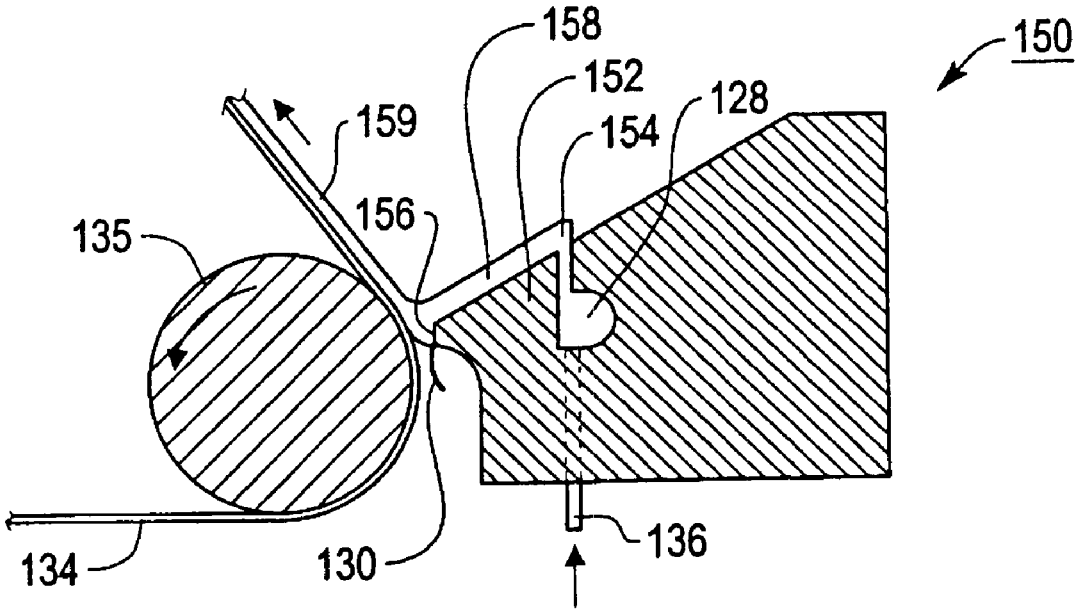
FIG. 2 illustrates a schematic cross-sectional view of a single layer slide coating system according to this invention.

FIG. 2 illustrates a slide die assembly 150 positioned adjacent to the substrate 134. The slide die assembly 150 comprises an inclined land 152 adjacent to and downstream from a passageway 154. The angle of slope of the inclined land 152 is dependent on the viscosity of the coating composition. In general, steeper angles of slope should be employed for higher viscosity coating compositions. A charge transport layer coating solution having a viscosity of between 1500–2100 cps is fed into the manifold 128 through the feed pipe 136 and is extruded as ribbon-like stream 158 through the passageway 154 and out onto the land 152, where the stream 158 flows by gravity toward the substrate 134. As in FIG. 1, the substrate 134 is supported by a rotatable roll 135.

The charge transport layer coating material forming the ribbon-like stream 158 flows by gravity over the land 152 and is deposited on the substrate 134 as a charge transport layer 159. A lip 156, located at the lower end of the land 152, is positioned close to, but spaced from, the surface of the substrate 134 by a gap 130 to prevent the ribbon-like stream 158 of coating material from escaping downwardly through the narrow gap 130 between the substrate 134 and the slide die assembly 150. As with single slot coating applicator assembly described above, end dams (not shown) are used to confine the coating compositions within the manifold 128 and the passageway 154 as the coating composition travels from the feed pipe 130, through the manifold 128, to the inclined land 152. The coated substrate 134 is thereafter transported to any suitable known or later developed drying device to dry coating material forming the charge generating layer and the ribbon-like stream 158 of material used to form charge transport layer coating.

Figure 3:
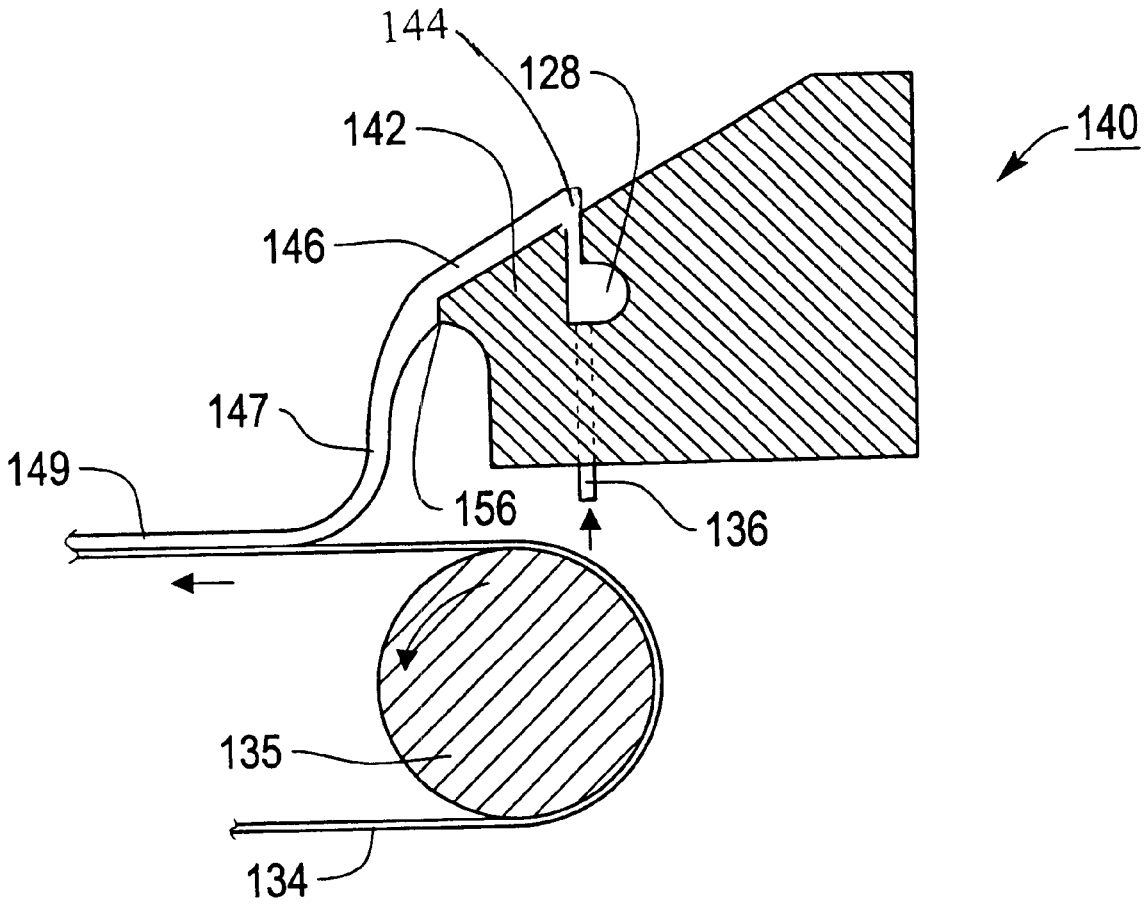
FIG. 3 illustrates a schematic cross-sectional view of a single layer curtain coating system according to this invention.

FIG. 3 illustrates a curtain die assembly 140, which, although similar in construction to the slide die assembly 150 illustrated in FIG. 2, is positioned further away from the substrate 134 to facilitate a falling curtain 147 of the charge transport layer coating stream 146 prior to it being deposited on the exposed surface of the substrate 134. The curtain die assembly 140 comprises an inclined land 142 adjacent to and downstream from a passageway 144. Depending on the coating solution behavior, the inclined land 142 is aligned to generate maximum flow uniformity. The angle of slope for the inclined land 142 is dependent on the viscosity of the coating composition used to form the charge transport coating stream 146. In general, steeper angles of slope should be employed for higher viscosity coating compositions.

A charge transport layer coating solution having a viscosity of between 1500–2100 cps is fed into the manifold 128 through the feed pipe 136 and is extruded as a ribbon-like stream 146 through the passageway 144 and out onto the inclined land 142, where the ribbon-like stream 146 flows by gravity toward the substrate 134. The substrate 134 is supported by the rotatable roll 135. In various exemplary embodiments, the exposed upper surface of the substrate 134 is aligned in a substantially horizontal attitude relative to the ribbon-like stream 146 at the location where the falling curtain 147 of the charge transport layer coating 149 are deposited on the substrate 134. Thus, the ribbon-like stream 146 of charge transport layer coating material flows by gravity over the inclined land 142, forms a falling curtain 147, and deposits on the substrate 134 as the charge transport layer 149. A lip 156, located at the lower end of the inclined land 142, directs the falling curtain 147 away from the curtain die assembly 100. As with the slide coating applicator assembly 150 described above, end dams (not shown) are used to confine the coating compositions within the manifold 128 and the passageway 144 as the coating composition travels from the feed pipe 136, through the manifold 128, to the inclined land 142. The coated substrate 134 is thereafter transported to any suitable drying device to dry the charge transport layer coating.

Selecting the die passageway height determines the thickness of the ribbon 146 of the coating material as it traverses through the passageway 144. The slope of an inclined land and the like generally depends upon factors such as the fluid viscosity, the surface tension, the flow rate, the distance to the surface of the support member 134, the relative movement between the curtain die and assembly 140 and the substrate 134, the desired thickness of the charge transport layer, and the like. Regardless of the technique employed, the flow rate and distance should be regulated to avoid splashing, dripping and puddling of the coating materials. For the type of die described in FIG. 1, generally satisfactory results may be achieved with narrow passageway heights between about 200 micrometers and about 1500 micrometers in the passageways for charge transport layers. The roof, sides and floor of the narrow die passageways should preferably be parallel and smooth to ensure achievement of laminar flow. The length of the narrow extrusion slot from the manifold to the outlet opening should be sufficient to ensure achievement of laminar flow and uniform coating solution distribution.

Relative speeds between an extrusion coating die assembly and the surface of the substrate 134 up to about 200 feet per minute have been tested. However, it is believed that greater relative speeds may be utilized if desired. The relative speed should be controlled in accordance with the flow velocity of the ribbon-like streams 126, 146 and/or 156 of the coating material used to form the charge transport layer.

The flow velocities or flow rate per unit width of the narrow die passageway 118, 144 and 154 for the ribbon-like streams 126, 146 and 158, respectively, of the coating material for the dies 100, 140 and 150, respectively, is determined by the targeted wet coating thickness $\delta_{wet}$ as defined by:

$$\delta=(Q/(W*V))*1\times10^{-6}$$

where:

$\delta_{wet}$ is the wet coating thickness in, micrometers;

Q is the coating flow rate, in $cm^3$/sec.;

W is the coating width, in cm; and

V is the substrate velocity, in cm/sec.

The coating flow rate should be sufficient to meet minimum conditions. In general, if the flow rate is too low, it is not possible to form a continuous film, resulting in ribbing defects or other defects associated with hydrodynamic instability.

The pressures utilized to extrude the coating compositions through the narrow die passageways 118, 144 or 154 depend upon the size of the passageways 118, 144 or 154 and the viscosity of the coating composition.

Figure 4:
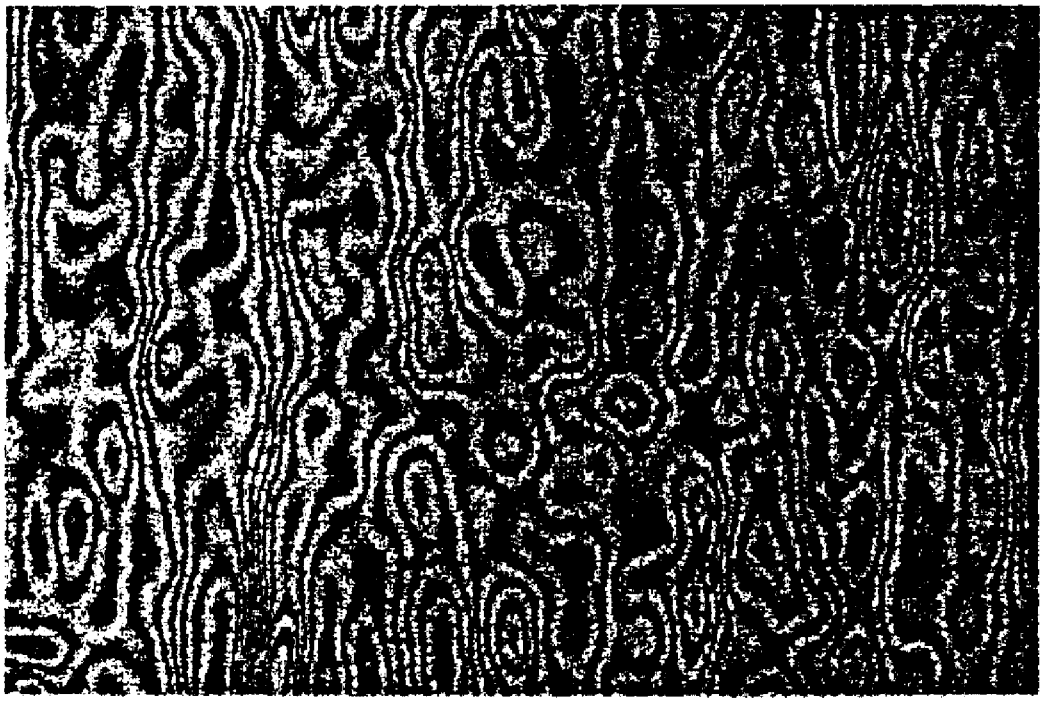
FIG. 4 illustrates a monochromatic interference image of high frequency thickness variability of a charge transport layer of a control photoreceptor exhibiting the raindrop defect.
Figure 5:
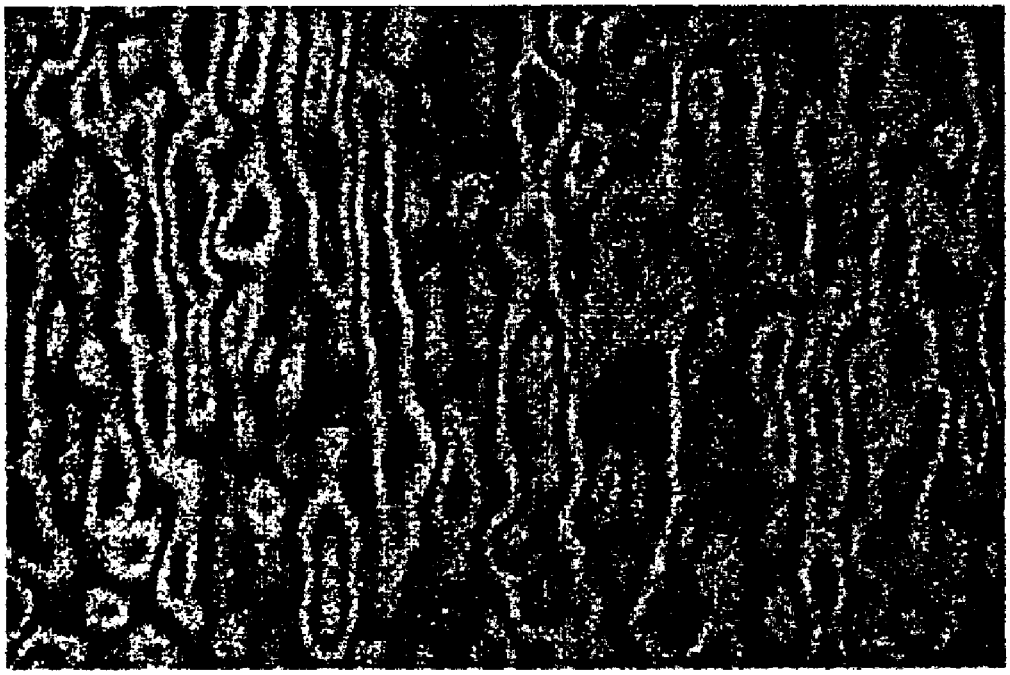
FIG. 5 illustrates a monochromatic interference image of high frequency thickness variability of a first charge transport layer of a photoreceptor resulting from the systems and methods according to this invention.

FIGS. 4 and 5 are essentially topographical maps of the transport layer thickness. Each line (fringe) in FIGS. 4 and 5, represent a 0.3-micrometer change in thickness. By counting the number of closed loop fringes in the pictures over a defined area, a measurement of the thickness uniformity can be made. FIG. 4 shows a 607 cps, 29 micrometer thick charge transport layer with a high frequency thickness variation of about 1.2–1.5 micrometer per square centimeter. FIG. 5 is a 2040 cps, 29 micrometer thick transport layer with a high frequency variation of about 0.3 micrometer per square centimeter. Thus, the thickness variation of the lower viscosity transport layer was about 200–500% greater than the thickness variation of the higher viscosity charge transport layer.

In addition, the width in each fringe is proportional to the steepness of the thickness change. Therefore, numerous sharply-defined fringes are analogous to a high, jagged mountain range. Widely spaced diffuse fringes, that appear poorly focused, are analogous to low, soft rolling hills.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A method of producing an electrophotograhic imaging member consisting of:

extrusion coating a substrate comprising an electrically conductive surface layer and a charge generating layer by applying a charge transport layer adjacent the charge generating layer in a single coating having a viscosity of about 1500–2100 cps, wherein the extrusion coating is selected from the group consisting of extrusion single slot coating; extrusion single layer slide coating and extrusion single layer curtain coating.

2. The method of claim 1, the substrate further comprising:

at least one of:

a charge blocking layer; and an adhesive layer.

3. The method of providing an electrophotographic imaging member of claim 1, wherein the charge transport layer has a thickness of about 29 micrometers.

4. The method of producing an electrophotographic member as disclosed in claim 1, wherein the charge transport layer has a thickness frequency variation of about 0.3 micrometers per square cm.

* * * * *